US009062835B2

(12) United States Patent
White

(10) Patent No.: US 9,062,835 B2
(45) Date of Patent: Jun. 23, 2015

(54) CANDLE HOLDER

(75) Inventor: Ron White, North Prairie, WI (US)

(73) Assignee: Lamplight Farms Incorporated, Menomonee Falls, WI (US)

( * ) Notice: Subject to any disclaimer, the term of this patent is extended or adjusted under 35 U.S.C. 154(b) by 481 days.

(21) Appl. No.: 13/073,313

(22) Filed: Mar. 28, 2011

(65) Prior Publication Data

US 2012/0251962 A1 Oct. 4, 2012

(51) Int. Cl.
*F23D 3/16* (2006.01)
*F21L 19/00* (2006.01)
*F21V 35/00* (2006.01)

(52) U.S. Cl.
CPC ..... *F21L 19/00* (2013.01); *Y10T 29/49826* (2015.01); *F21V 35/00* (2013.01); *F23D 3/16* (2013.01)

(58) Field of Classification Search
CPC ..... F23D 3/16; F23P 11/00
USPC ..... 431/291, 290, 293, 126, 289; 29/428
See application file for complete search history.

(56) References Cited

U.S. PATENT DOCUMENTS

| | | | | |
|---|---|---|---|---|
| D25,976 | S | | 8/1896 | Shaw |
| 613,188 | A | | 10/1898 | Cadwallader et al. |
| 1,299,977 | A | | 4/1919 | McGuire |
| 1,345,960 | A | | 7/1920 | Rosenberger |
| 1,367,921 | A | | 2/1921 | Pomije |
| 1,705,877 | A | | 3/1929 | Ramsey |
| D101,041 | S | | 9/1936 | Janssen |
| 2,812,653 | A | * | 11/1957 | Meunier ..... 431/291 |
| 3,244,872 | A | * | 4/1966 | McCormick ..... 40/540 |
| 3,327,108 | A | | 6/1967 | Press |
| D220,642 | S | | 5/1971 | Morehead |
| D221,585 | S | | 8/1971 | Moore |
| 3,603,784 | A | | 9/1971 | Wellhofer |
| 3,790,772 | A | | 2/1974 | Newman et al. |
| 4,117,533 | A | | 9/1978 | Hagelthorn |
| 4,163,333 | A | | 8/1979 | Kwiatkowski |
| D254,695 | S | | 4/1980 | Bobrovniczky |
| D262,999 | S | * | 2/1982 | Spencer ..... D26/11 |
| 4,787,017 | A | | 11/1988 | Vrettos |
| 5,101,328 | A | | 3/1992 | Hai |
| 5,255,169 | A | | 10/1993 | Kock |
| D383,555 | S | | 9/1997 | Hardy |
| 5,683,239 | A | | 11/1997 | Cardosi |
| 5,797,671 | A | | 8/1998 | Gess |
| D412,213 | S | | 7/1999 | Andujar |
| D429,018 | S | | 8/2000 | De'Armond |
| D430,334 | S | | 8/2000 | Hsu |
| D442,302 | S | | 5/2001 | Hsu |
| 6,305,826 | B1 | | 10/2001 | Yang |
| D457,979 | S | | 5/2002 | Chen |
| 6,435,694 | B1 | | 8/2002 | Bell et al. |
| 6,468,071 | B2 | | 10/2002 | Zou |
| 6,474,980 | B2 | | 11/2002 | LaVanier |
| D469,203 | S | | 1/2003 | DiPasquale |

(Continued)

FOREIGN PATENT DOCUMENTS

| | | |
|---|---|---|
| JP | 2002-329402 | 11/2002 |
| WO | WO2005022035 | 3/2005 |

*Primary Examiner* — Gregory Huson
*Assistant Examiner* — Nikhil Mashruwala
(74) *Attorney, Agent, or Firm* — Fellers, Snider, Blankenship, Bailey & Tippens, P.C.

(57) ABSTRACT

A candle holder has a double walled container and a lid fitting the container and suspending a candle platform into the double walled container.

18 Claims, 2 Drawing Sheets

(56) References Cited

U.S. PATENT DOCUMENTS

| | | | | |
|---|---|---|---|---|
| D470,968 | S | 2/2003 | Kuelbs et al. | |
| 6,520,770 | B2 | 2/2003 | Zou | |
| 6,554,448 | B2 | 4/2003 | Carpenter et al. | |
| D482,478 | S | 11/2003 | Cheong et al. | |
| D483,895 | S | 12/2003 | Kuelbs et al. | |
| D486,925 | S | 2/2004 | Cuevas et al. | |
| 6,705,741 | B2 | 3/2004 | Bonnema et al. | |
| 6,716,026 | B1 | 4/2004 | Beougher | |
| 6,736,530 | B2 | 5/2004 | Thevenot | |
| 6,758,666 | B1 | 7/2004 | Strunak | |
| D500,876 | S | 1/2005 | Bucher et al. | |
| 6,869,200 | B1 | 3/2005 | Graham | |
| 7,204,618 | B1 | 4/2007 | Kuelbs et al. | |
| D542,965 | S | 5/2007 | Layne | |
| D550,891 | S | 9/2007 | Miranda | |
| 7,314,293 | B2 | 1/2008 | Steier et al. | |
| D563,585 | S | 3/2008 | Lee et al. | |
| 7,377,667 | B2 | 5/2008 | Richmond | |
| 8,342,839 | B2 * | 1/2013 | Rindom | 431/289 |
| 2001/0036069 | A1 * | 11/2001 | Franks | 362/122 |
| 2002/0032982 | A1 | 3/2002 | Berger et al. | |
| 2003/0131506 | A1 | 7/2003 | Frazer | |
| 2007/0242451 | A1 | 10/2007 | Richmond | |
| 2007/0248922 | A1 | 10/2007 | Mahdavieh | |
| 2009/0027871 | A1 | 1/2009 | Chadha | |
| 2009/0080203 | A1 | 3/2009 | McCauley | |
| 2009/0081600 | A1 | 3/2009 | Weathersbee | |
| 2009/0129066 | A1 | 5/2009 | Chadha | |

* cited by examiner

CANDLE HOLDER

FIELD OF THE INVENTION

This disclosure relates to decorative lighting in general and, more specifically to candle holders.

BACKGROUND OF THE INVENTION

Candles have been used for lighting since ancient times. Although modern households rely on electric lighting, the use of candles has never completely subsided. Candles are used even in modern times as a backup or emergency lighting source, for ambiance, to disperse scents or repellants, for decoration, and for other purposes.

It is often easier to use candles if they are placed in a candle holder. Candle holders can help to isolate the flame from potentially flammable materials thereby making the candle safer to use. In the past, candle holders have accomplished some of the purposes of safety but have provide limited utility. Furthermore, depending upon the design of the candle holder, the light and utility of the candle may actually be diminished.

What is needed is a candle holder to address the above limitations.

SUMMARY

The invention of the present disclosure, in one embodiment thereof, comprises a candle holder comprising. The candle holder has a double walled container and a lid fitting the container and suspending a candle platform into the double walled container. In some embodiments the double walled container is cylindrical with clear walls. The walls may comprise glass or another heat resistant material.

The lid of the candle holder, in some embodiments, covers a space between the double walls and is open above the candle platform. The candle platform may be suspended from the lid by a pair of wires having a length placing the candle platform proximate a bottom of the double walled container.

In one embodiment, the candle holder has a double walled container comprising concentric glass cylinders joined by a toroidal floor on a bottom of the cylinders. In this embodiment the lid further comprises a complementary toroidal covering on a top of the cylinders and at least one attached wire suspending the candle platform proximate the bottom of the cylinders.

DETAILED DESCRIPTION OF THE PREFERRED EMBODIMENTS

Figure 1:
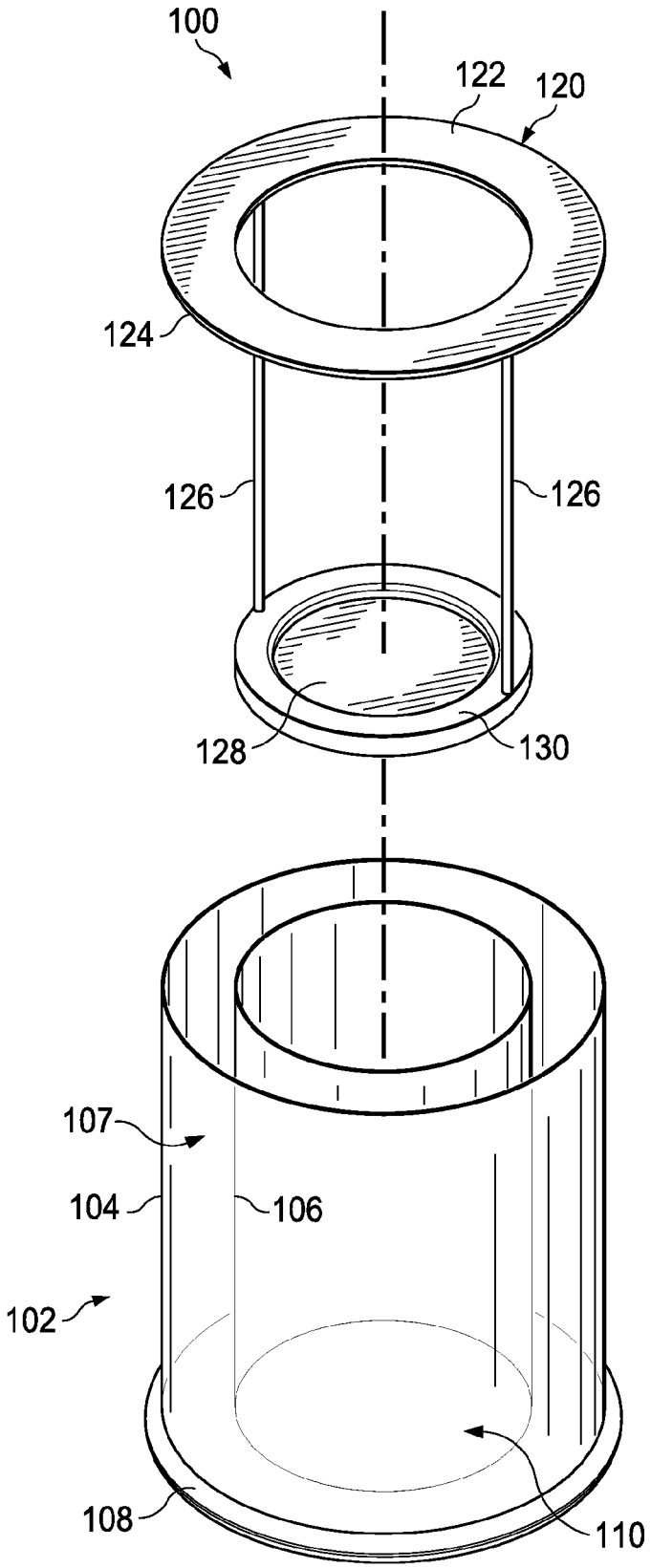
FIG. 1 is a perspective view of a candle holder container and cap according to aspects of the present disclosure.

Referring now to FIG. 1, a perspective view of a candle holder and cap according to aspects of the present disclosure is shown. The candle holder 100 comprises a container 102. In the present embodiment, the container 102 comprises an outer wall 104 and an inner wall 106. A space 107 is defined between the outer wall 104 and the inner wall 106. In some embodiments, this space 107 will serve as an insulating barrier and, in other embodiments, may be used for decorative purposes, as will be described further below. In the present embodiment, the outer wall 104 and the inner wall 106 connect to the base 108.

In some embodiments, the outer and inner wall 104, 106, will be formed from separate pieces and attached to the base 108. In other embodiments, the outer wall 104 and inner wall 106 may be formed integrally and then attached to the base 108. In some embodiments, the walls 104, 106 will be made from glass. In other embodiments, the walls 104, 106 may comprise some other heat resistant and suitably translucent or transparent material (such as, for example, heat resistant plastic). In some embodiments, a substantially transparent wall design will be utilized to allow for lighting from a candle to shine through the walls and for allowing the candle to backlight decorative items, as will be described more fully below.

The base 108 may provide an opening 110 such that the bottom of the container 102 is open. The base may be made from a metal or plastic or other resilient or durable material. In one embodiment, the walls 104, 106 will be glued to the base 108.

The candle holder 100 in the present embodiment also comprises a lid 120. The lid 120 has a top 122 which can be seen as being generally toroidal in shape. In the present embodiment, the top 122 is generally of an open disk shape with a width covering the distance between the outer wall 104 and the inner wall 106. A lip 124 may be formed around the periphery of the top 122 to ensure that the lip 120 is centered on the container 102 when placed thereon. A set of hangers 126 extends generally downwardly from the top 122 and suspends a candle platform 128. The candle platform 128 may also have a lip 130 around a periphery thereof to secure a candle. All of the components of the lid 120 may be metal or suitable heat resistant plastic. The hangers 126 may be a stiff wire that is capable of suspending the base 128 in a level and secure relationship with regard to the top 122.

Figure 2:
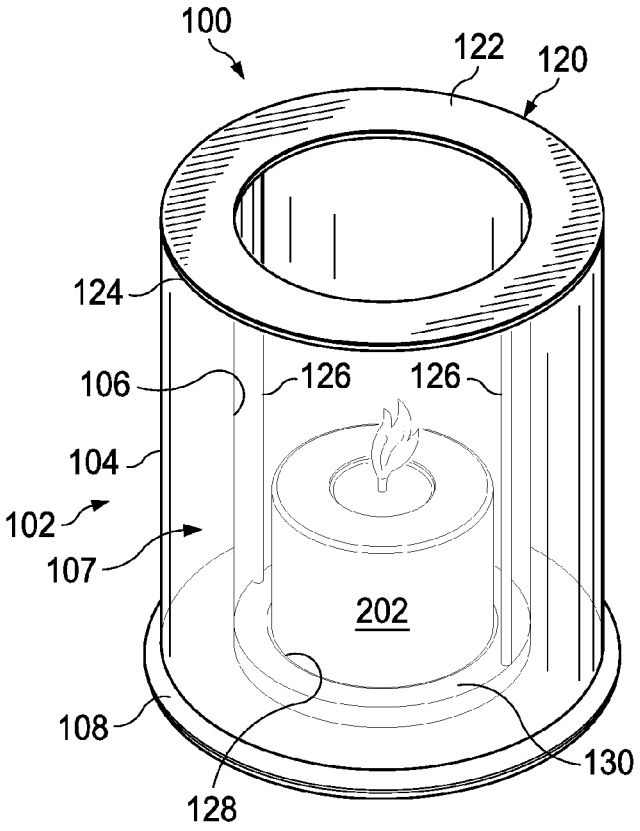
FIG. 2 is a perspective view of the candle holder of FIG. 1 with the cap in place with a candle.

Referring now to FIG. 2, a perspective view of the candle holder of FIG. 1 with the cap in place with a candle is shown. Here, the lid 120 is seen in place on the container 102. It can be seen that when the lid 120 is placed upon the container 102, the platform 128 will be at approximately the same level as the base 108 of the container 102. A candle 202 is shown resting on the platform 128. It can be seen that to replace or remove the candle 202, the user need only lift the lid 120. This will allow easy access to the candle platform 128. In this manner, if a candle becomes stuck or melted to the platform 128, it may be easily removed for cleaning. It will also be appreciated that, because the walls 104, 106 may be substantially transparent or translucent, any light from the candle 202 will be substantially unimpeded by the candle holder 100. It can be seen that the walls 104, 106 in conjunction with the space 107 therebetween will serve to insulate the user from any heat given off by the candle 202.

Figure 3:
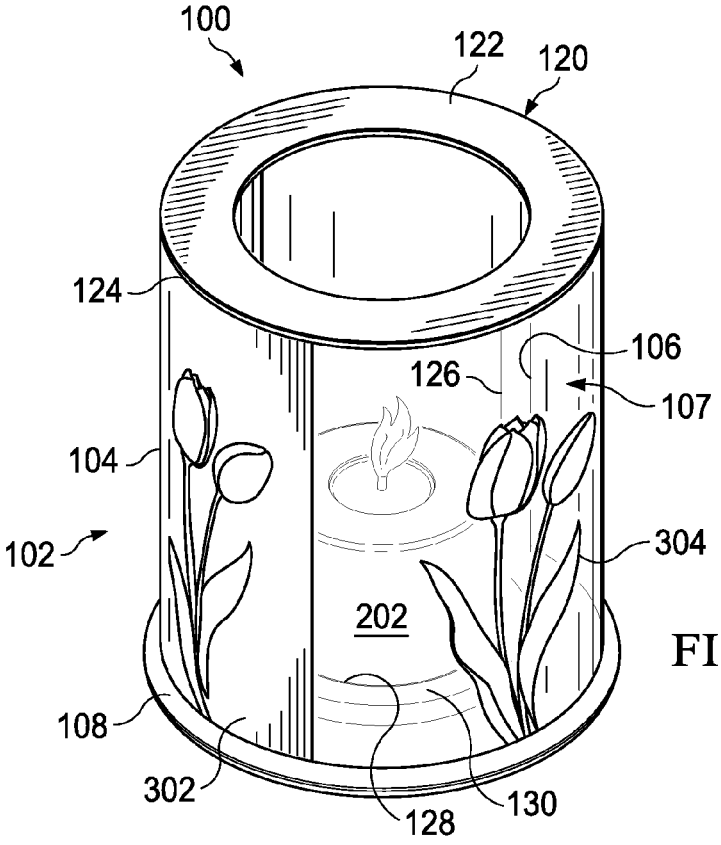
FIG. 3 is a perspective view of the candle holder of FIG. 1 with exemplary decorations.

Referring now to FIG. 3, a perspective view of the candle holder of FIG. 1 with exemplary decorations is shown. In the present embodiment, a photograph 302 has been placed within the space 107 between the walls 104, 106. This may be done for decorative or backlighting purposes. The embodiment of FIG. 3 also provides a shadow-type decoration 304 that may be backlit by the candle 202, thereby casting pleasing or decorative shadows. Although only two decorations are shown in FIG. 3, it is understood that the number and type of decorations is not meant to be limited by the present disclosure. It will also be appreciated that the design of the candle holder 100 with the lid 120 securely encapsulating the decorations 302, 304 will keep the decorations 302, 304 in relative safety.

Although generally cylindrical or circular walls 104, 106 are employed in candle holder 100, shown in FIGS. 1-3, other shapes are possible. For example, the candle holder could have an oval cross section. In this way the candle holder would present a broader side when viewed from certain angles. Similarly, square or rectangular cross sections could be employed. In other embodiments, other more complex cross sections could be molded and formed (such star-shaped). The corresponding tops and candle platforms of these embodiments would be formed to match the shape of the walls such that the candle holder would operate in substantially the same manner as described with respect to FIGS. 1-3.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A candle holder comprising:

a double walled container; and a lid fitting the container and suspending a candle platform into the double walled container;

wherein the lid has an outer edge that is flush with an outer wall of the double walled container, covers a space between the double walls and is open above the candle platform; and wherein the candle platform has a recessed surface and is suspended from the lid by a pair of wires having a fixed length placing the candle platform in a fixed location proximate a bottom of the double walled container.

2. The candle holder of claim 1, wherein the double walled container is cylindrical with clear walls.

3. The candle holder of claim 2, wherein the double walled container is a heat resistant material.

4. The candle holder of claim 2, wherein the double walled container has walls comprising glass.

5. The candle holder of claim 1:

wherein the double walled container further comprises concentric glass cylinders joined by a toroidal floor on a bottom of the cylinders; and wherein the lid further comprises a complementary toroidal covering on a top of the cylinders and at least one attached wire suspending the candle platform proximate the bottom of the cylinders.

6. The candle holder of claim 1, further comprising a lip on the lid for fitting the outer wall.

7. A candle holder comprising:

a container having transparent double walls and a toroidal base connecting the walls; and a lid having a toroidal top with an outer edge that is flush with an outer wall of the transparent double walls, the top covering a top opening of the double walls and having a set of fixed-length hangers suspending a candle platform with a recessed surface proximate the base at a fixed height inside the double walls such that a lit candle on the candle platform illuminates at least the interior of the doubled-walled container.

8. The candle holder of claim 7, wherein the lid further comprises an outer lip configured to surround an outer wall of the transparent double walls to center the lid on the transparent double walls.

9. The candle holder of claim lip 7, wherein the platform has a lip for centering candle thereon.

10. The candle holder of claim 7, wherein the transparent double walls comprise glass.

11. The candle holder of claim 7, wherein the toroidal base connecting the walls is open in a center thereof.

12. The candle holder of claim 7, wherein the transparent double walls comprise inner and outer glass cylinders having open tops and bottoms.

13. The candle holder of claim 7, wherein the top, hangers, and platform are metallic.

14. The candle holder of claim 7, further comprising a lip on the lid for fitting the outer wall.

15. A method of making a candle holder comprising:

providing inner and outer concentric transparent walls; and providing a lid with an outer edge flush with an outer wall spanning a space between the walls and suspending a candle platform having a recessed surface inside a space defined within the inner concentric transparent wall;

wherein the candle platform is non-adjustably suspended by fixed-length wires proximate a bottom edge of the inner concentric transparent wall.

16. The method of claim 15, further comprising providing an open centered base connecting the inner and outer walls on a bottom thereof.

17. The method of claim 15, further comprising forming the inner and outer concentric walls of glass.

18. The method of claim 15, further comprising forming a lip on the lid for fitting the outer transparent wall.

* * * * *